US012398490B1

(12) United States Patent
Tao et al.

(10) Patent No.: US 12,398,490 B1
(45) Date of Patent: Aug. 26, 2025

(54) MANUFACTURING METHOD FOR LAYERED HAIRPIECE PRODUCT

(71) Applicant: SHANDONG HAICHUAN HAIR ARTS CO., LTD., Shandong (CN)

(72) Inventors: Lin Tao, Shandong (CN); Ying Tang, Shandong (CN)

(73) Assignee: SHANDONG HAICHUAN HAIR ARTS CO., LTD., Qingdao (CN)

( * ) Notice: Subject to any disclaimer, the term of this patent is extended or adjusted under 35 U.S.C. 154(b) by 0 days.

(21) Appl. No.: 18/979,670

(22) Filed: Dec. 13, 2024

(30) Foreign Application Priority Data

Oct. 22, 2024 (CN) ..... 202411476054.5

(51) Int. Cl.
*D01G 1/10* (2006.01)
*A41G 3/00* (2006.01)

(52) U.S. Cl.
CPC ..... *D01G 1/10* (2013.01); *A41G 3/0075* (2013.01)

(58) Field of Classification Search
CPC . D01G 1/00; D01G 1/10; D01G 17/00; A41G 3/0075; A41G 3/0083
See application file for complete search history.

(56) References Cited

U.S. PATENT DOCUMENTS 2,249,083 A * 7/1941 Kern ..... D01G 1/10 19/0.56
2,250,575 A * 7/1941 Dreyfus ..... D01G 1/10 19/0.48
2,260,383 A * 10/1941 Killars, Jr. ..... D01G 1/10 19/0.51
2,323,300 A * 7/1943 Abbott ..... D01G 1/10 19/0.6
2,825,937 A * 3/1958 Guimbretiere ..... D01G 1/10 19/288
3,943,805 A * 3/1976 Lubitzsch ..... D01G 1/10 83/423
5,405,683 A * 4/1995 Sandusky ..... B29C 70/34 428/105
5,878,464 A * 3/1999 White ..... D01G 1/10 219/121.72
10,786,026 B1 * 9/2020 Jhin ..... A41G 5/0046
(Continued)

FOREIGN PATENT DOCUMENTS

EP 0044933 A2 * 2/1982 ..... B65H 54/2812
GB 1434330 A * 5/1976 ..... D01G 1/10
WO WO-2023181672 A1 * 9/2023 ..... A41G 3/00

OTHER PUBLICATIONS

Translation of EP 0044933.*

*Primary Examiner* — Shaun R Hurley

(57) ABSTRACT

The present invention belongs to the technical field of wig production and specifically relates to a manufacturing method for layered hairpiece product. The manufacturing method for preparing layered hairpiece product comprises the following steps: step I. preparing a raw hairpiece; step II. cutting a manufacturing unit: cutting one or more manufacturing units having a trapezoidal shape from the raw hairpiece; and step III. homogeneously mixing each manufacturing unit. In the present invention, after cutting the layered part having a trapezoidal shape and mixing the same homogeneously, the layered part of the layered hairpiece product resembles a natural look at the hair ends with high similarity to real hairs.

11 Claims, 3 Drawing Sheets

(56) References Cited

U.S. PATENT DOCUMENTS

| | | | | |
|---|---|---|---|---|
| 10,945,478 | B1 * | 3/2021 | Jhin | B65B 1/04 |
| 10,980,301 | B1 * | 4/2021 | Jhin | A41G 5/006 |
| 2018/0186020 | A1 * | 7/2018 | Noguchi | B26D 7/08 |
| 2019/0191803 | A1 * | 6/2019 | Han | A41G 5/0046 |

* cited by examiner

MANUFACTURING METHOD FOR LAYERED HAIRPIECE PRODUCT

TECHNICAL FIELD

The present invention belongs to the technical field of wig production and specifically relates to a manufacturing method for layered hairpiece product.

BACKGROUND ART

A layered hairpiece product (hereafter referred to as hairpiece product for short) 1 has layered parts at two ends, which imitate the ends of human hair. Namely, the hairpiece product comprises a middle part with a consistent thickness and two ends with gradually thinned hair. In this case, the single hairs forming the hairpiece product have different lengths and constitute a main part 2 of the hairpiece product by filling up the middle part of the hairpiece product. The ends of the single hairs are arranged in layers at both ends of the hairpiece product, thereby achieving a natural look of a layered tail part of the hairpiece product. The parts of the ends of the single hairs, which are arranged in layers, at both ends of the hairpiece product constitute a layered part 3 of the hairpiece product. The total length of the hairpiece product equals to the sum of the length of the main part of the hairpiece product and 2 times the length of the layered part of the hairpiece product.

In the American patent U.S. Pat. No. 10,945,478, a hair accessory is disclosed, comprising: bundled synthetic braiding hair, comprising: a first bundle of synthetic hair strands having a predefined length; and a second bundle of synthetic hair strands also having the predefined length; wherein a center of the first bundle of synthetic hair strands and a center of the second bundle of synthetic hair strands are offset by a predefined distance; and wherein the bundled synthetic braiding hair is folded about a waist of the bundled synthetic braiding hair to define a perimeter having a first end collocated with the waist, a middle, and a second end located distally from the waist; and wherein a width of the perimeter narrows as the bundled synthetic braiding hair extends distally from the middle of the perimeter to the second end. Furthermore, a method of packaging a hair accessory is disclosed, comprising: obtaining a first bundle of synthetic hair strands; obtaining a second bundle of synthetic hair strands; offsetting a center of the first bundle of synthetic hair strands from a center of the second bundle of synthetic hair strands by a predefined distance; bundling the first bundle of synthetic hair strands and the second bundle of synthetic hair strands to form bundled synthetic braiding hair; and folding the bundled synthetic braiding hair about a waist of the bundled synthetic braiding hair to define a perimeter having a first end collocated with the waist, a middle, and a second end located distally from the waist, wherein a width of the perimeter narrows from the middle to the second end. The method further comprises obtaining: a third bundle of synthetic hair strands; a fourth bundle of synthetic hair strands; and offsetting a center of the third bundle of synthetic hair strands and a center of the fourth bundle of synthetic hair strands from the center of the first bundle of synthetic hair strands and the center of the second bundle of synthetic hair strands; and bundling the third bundle of synthetic hair strands and the fourth bundle of synthetic hair strands with the first bundle of synthetic hair strands and the second bundle of synthetic hair strands.

However, the technique in the patent mentioned above has the following shortcomings: Firstly, two or more types of hairs with fixed lengths are used to manufacture the hairpiece product, so that an operator needs to mount the hairs on a rake with multiple rows of teeth and spread and draw the hairs repeatedly during the production. In order to achieve a required layering and gradation of the hairpiece product, the operator has to control his or her physical power and technique rationally, which sets high requirements of the skill and physical effort of the operator and hence causes a higher risk of occupational diseases. In practice, this leads to significant insufficiency of qualified operators. Secondly, the natural look of the arrangement of the hair ends of the layered part has low similarity to those of the real hairs and is not satisfactory enough.

SUMMARY OF THE INVENTION

In order to solve the problems mentioned above, the object of the present invention is to provide a manufacturing method for layered hairpiece product, so that the layered part of the layered hairpiece product is arranged naturally at hair ends with higher similarity to real hairs. Furthermore, the problem of insufficient operators in the production is solved and the operators are better protected from occupational diseases.

In order to achieve the above-mentioned objective, the technical solution used in the present invention is as follows. The manufacturing method for preparing layered hairpiece product comprises the following steps:

step I. preparing a raw hairpiece;

step II. cutting a manufacturing unit: cutting one or more manufacturing units having a trapezoidal shape from the raw hairpiece; and step III. homogeneously mixing each manufacturing unit.

Preferably, in step II of cutting a manufacturing unit, the one or more manufacturing units are cut from a start end of the raw hairpiece successively.

Preferably, the length of a longer side of the trapezoidal shape of the manufacturing unit is smaller than the total length of the hairpiece product. The length of the layered part corresponding to a lateral side of the trapezoidal shape is smaller than the length of the layered part of the hairpiece product. The manufacturing method further comprises step IV of dragging the manufacturing unit: dragging parts of the hair at two ends of the manufacturing unit outwards to a certain length, until the length of the manufacturing unit reaches the total length of the hairpiece product.

Preferably, the step IV of dragging the manufacturing unit is specifically carried out as follows: holding a middle part of the manufacturing unit by hand, and dragging the parts of the hair at two ends outwards to a certain length multiple times.

Preferably, the step I of preparing a raw hairpiece is specifically carried out as follows: passing the start end of the raw hairpiece between processing plates, with the raw hairpieces being arranged evenly between the processing plates and the start end of the raw hairpiece protruding from the processing plates by a certain length.

Preferably, the distance between two processing plates is adjusted according to hair amount of the manufacturing unit.

Preferably, the cutting of a first manufacturing unit in step II is specifically carried out as follows: beginning from the start end of the raw hairpiece, on one side of the processing plates, cutting from a first cutting point on one side of the raw hairpiece to a second cutting point on the other side of the raw hairpiece in an inclined upward direction; then on the other side of the processing plates, cutting from a third cutting point on one side of the raw hairpiece to a fourth cutting point on the other side of the raw hairpiece in an inclined upward direction; and separating the first manufacturing unit having a trapezoidal shape formed by the first cutting point, the second cutting point, the third cutting point, and the fourth cutting point from the remaining raw hairpiece at the lateral side formed by the third cutting point and the fourth cutting point.

Preferably, the cutting of a second manufacturing unit in step II is specifically carried out as follows: passing a start end of the remaining the raw hairpiece between the processing plates, with the remaining raw hairpieces being arranged evenly between the processing plates and the start end of the remaining raw hairpiece being the lateral side defined by the third cutting point and the fourth cutting point, then on the other side of the processing plates, cutting from a fifth cutting point on one side of the raw hairpiece to a sixth cutting point on the other side of the raw hairpiece in an inclined upward direction; separating the second manufacturing unit having a trapezoidal shape formed by the third cutting point, the fourth cutting point, the fifth cutting point, and the sixth cutting point from the remaining raw hairpiece at the lateral side formed by the fifth cutting point and the sixth cutting point; and repeating the cutting of the second manufacturing unit in the same way, in order to obtain a plurality of manufacturing units.

Preferably, one or more of scissors, laser or forged blade is or are used as cutting tool, and the cutting is carried out manually or by machine.

Preferably, the lateral side of the trapezoidal shape is a segment or a plurality of segments of curve or straight line, the longer side or the shorter side of the trapezoidal shape is a start segment or an end segment, and the middle part is a middle segment, the slopes and the hair amounts of the start segment, the end segment and the middle segment being determined according to the requirements of the layered part of the hairpiece product.

Preferably, the step III of homogeneously mixing each manufacturing unit is specifically carried out by manually mixing and combing, which are repeated multiple times.

Preferably, the manual mixing can be carried out regularly or irregularly, and the combing is carried out by hand and comb.

Preferably, the manual mixing is carried out through winding.

Preferably, a first winding operation is specifically carried out as follows: winding the hair inwards to form a circular hair bundle, starting from the shorter side or the longer side of the trapezoidal shape. The combing is specifically carried out as follows: holding a middle part of the circular hair bundle after winding, teasing two ends of the hair by hand and comb, and putting down the circular hair bundle. A second winding operation is specifically carried out as follows: winding the hair inwards to form a circular hair bundle, starting from one side of the trapezoidal shape; and repeating the combing and the second winding operation successively multiple times.

Preferably, the winding is carried out manually or by machine, and the combing is carried out manually or by machine.

Preferably, the total number of winding operations is 2-8, and the total number of combing operations is 2-8, and the length of the longer side, the length of the shorter side, and the length of the layered part corresponding to the lateral side of the trapezoidal shape of the manufacturing unit are determined according to the requirements of the layered part of the hairpiece product.

A trapezoidal shape can be understood as such a cut manufacturing unit, in which the upper and lower sides in the longitudinal direction of the hair are generally parallel to each other and form the two parallel bases of the trapezoidal shape (i.e. the longer side and the shorter side of the trapezoidal shape), and in which the two lateral sides that are cut with a certain angle relative to the longitudinal direction of the hairs (i.e. the legs of the trapezoidal shape) form the two legs of the trapezoidal shape.

In the present invention, the raw hairpiece used has a certain length, from which the manufacturing unit having a trapezoidal shape is cut directly. The two lateral sides of the trapezoidal shape are obtained by continuous cutting, so that the length of the involved hairs gradually increases in a continuous manner. After the step of homogenization, the hairs in the manufacturing unit are mixed homogeneously. Since the two lateral sides of the trapezoidal shape are formed by continuous cutting, the layered part formed at the tail part of the hairpiece product after homogeneous mixing better resembles a natural look. In the present invention, because of the formation of the layered part on the basis of the cut trapezoidal shape, the realization of the layering effect by repeated spreading and drawing the hairs on the rake by the operator is no longer necessary. The problem of insufficient operators in the production is solved and the operators are better protected from occupational diseases.

The raw hairpiece can be hairs which are either processed or unprocessed and suitable for the manufacturing the hairs of the hairpiece product.

The length of the manufacturing unit refers to the distance between tails at the two ends of the manufacturing unit in the longitudinal direction of the hair, i.e., the full length of the manufacturing unit.

The total length of the hairpiece product is determined according to the demands of the product and the market. The number of continuously produced manufacturing units is one or more, and the specific number depends on the full length of the raw hairpiece and to the length of the manufacturing unit. If the raw hairpiece has a greater full length, 120 or even more manufacturing units can be manufactured generally by cutting continuously. Scraps are only produced at two ends of the raw hairpiece, while all other parts are all made into manufacturing units, thereby substantially increasing the utility rate of the raw hairpiece.

The length of the longer side of the trapezoidal shape of the manufacturing unit is the length of the longer side of the parallel bases of the trapezoidal shape. The length of the shorter side of the trapezoidal shape of the manufacturing unit is the length of the shorter side of the parallel bases of the trapezoidal shape. The length of the layered part corresponding to the lateral side of the trapezoidal shape is the length of the hair in the layered part in the longitudinal direction of the longer side of the trapezoidal shape, i.e., one half of the difference between the longer side and the shorter side of the trapezoidal shape.

The length of the longer side of the trapezoidal shape of the manufacturing unit may be smaller than the total length of the hairpiece product, and the length of the manufacturing unit can be increased to the total length of the hairpiece product by dragging the parts of the hairs at two ends of the hairpiece of the manufacturing unit.

The dragging realizes a more natural overall state of the hairpiece product with different hair lengths, which resembles the look of natural human hairs.

During step I of preparing the raw hairpiece, since the raw hairpiece exists usually in form of a bunch or bundle, it is freely, preferably homogeneously, spread between the processing plates, thereby simplifying the operation. The protrusion of the start end of the raw hairpiece from the processing plates facilitates the cutting operation.

During step II of cutting a first manufacturing unit, it is possible to cut from a first cutting point on one side of the raw hairpiece to a second cutting point on the other side of the raw hairpiece in an inclined left-upward direction, and at the same time, cut from a third cutting point on one side of the raw hairpiece to a fourth cutting point on the other side of the raw hairpiece in an inclined right-upward direction. Alternatively, it is also possible to cut from a first cutting point on one side of the raw hairpiece to a second cutting point on the other side of the raw hairpiece in an inclined right-upward direction, and at the same time, cut from a third cutting point on one side of the raw hairpiece to a fourth corresponding cutting point on the other side of the raw hairpiece in an inclined left-upward direction. In summary, the first and second cutting points and the third and fourth cutting points have the opposite inclined upward directions, so as to construct the trapezoidal shape. The same applies for the cutting of other manufacturing units.

The lateral side of the trapezoidal shape, namely the lateral side cut with a certain angle relative to the longitudinal direction of the hairs, is a segment or a plurality of segments of curve or straight line, the longer side or the shorter side of the trapezoidal shape is a start segment or an end segment, and the middle part is a middle segment, the slopes and the hair amounts of the start segment, the end segment and the middle segment being determined according to the effects and the requirements of the layered part of the hairpiece product. For example, the lateral side of the trapezoidal shape comprises three segments of straight line. In this case, the slopes of the start segment, the end segment and the middle segment refer to the angles included by their respective extension lines and the longer side of the trapezoidal shape.

The step III of homogeneously mixing each manufacturing unit is specifically carried out by manually mixing and combing, which are repeated multiple times. The manual mixing refers to a mixing operation carried out by hand, for the purpose of homogenizing the hairs in the manufacturing unit. The manual mixing can be done in any manner. The manual mixing can be carried out regularly or irregularly. The regular manual mixing includes not only winding, but also moving the hairs from back to front, from front to back, from top to bottom, from bottom to top, etc. The irregular manual mixing can be arbitrary, random moving and mixing without any fixed direction.

The first winding begins from the shorter or longer side of the trapezoidal shape. The hairs are successively wound inwards to form a circular hair bundle (which has a circular cross-section), whereby the shorter or longer hairs are led to the interior of the hair bundle and are surrounded by the longer or shorter hairs. After combing both ends of the hairs by teasing, the circular hair bundle is put down. The hairs are mixed into each other. A second winding begins from one side. The hairs are successively wound inwards to form a circular hair bundle, whereby the hairs on the one side are led to the interior of the hair bundle and are surrounded by the hairs on the other side. After combing both ends of the hairs by teasing, the circular hair bundle is put down. The hairs are further mixed into each other. After winding and combing multiple times, the hairs with different lengths are homogeneously mixed, so that the hairpiece product possesses a more natural look at the layered part.

The combing can be carried out by hand using either an ordinary comb or a customized comb-like tool.

The total amount of winding operations in the present application means the full number of times the winding, including the first winding, the second winding, etc., should be carried out until each of the manufacturing units are homogeneously mixed. The total amount of combing operations means the full number of times the combing, including the first combing, the second combing, etc., should be carried out until each of the manufacturing units are homogeneously mixed.

When the winding operation and combing operation are each conducted only once, the natural look of the layered part is limited, and its effect improves with the number of times. However, the improvement becomes insignificant after 10 times, which makes more winding and combing unnecessary. Therefore, the total numbers of winding operations and combing operations are preferably 2-8.

In the present invention, because of the cut trapezoidal shape, the realization of the layering effect by repeated spreading and drawing the hairs on the rake by the operator is no longer necessary. Moreover, through the skillful winding and combing, the final product according to the present invention highly resembles the result achieved by a hairdresser and the layered part of the hairpiece product has a natural look. Through the winding and combing operations, on one hand, the hairs can be fast and thoroughly homogenized, in order to obtain the product. On the other hand, the winding action saves time and effort advantageously and the combing operation can be done by hand using an ordinary comb, which is simple and easy to implement without requiring too much physical strength or skill. Thus, the problem of insufficient skillful operators in the production is solved, while the protection of the operators from occupational diseases is maximized.

In summary, the positive effects of the present invention lie in: After cutting the layered part having a trapezoidal shape and mixing the same homogeneously, the layered part of the layered hairpiece product resembles a natural look at the hair ends with high similarity to real hairs. Furthermore, the problem of insufficient operators in the production is solved and the operators are better protected from occupational diseases.

Furthermore, the similarity of the hairpiece product to real hairs is increased through the dragging step.

Furthermore, a plurality of manufacturing units can be cut successively from the raw hairpiece using the method provided in the present invention, thereby reducing the losses of the raw materials and increasing the manufacturing efficiency.

LIST OF REFERENCE NUMERALS

Figure 1:
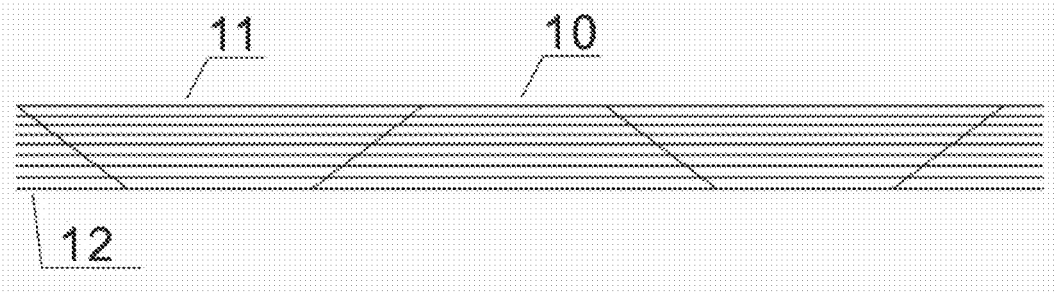
FIG. 1 is a schematic view of the arrangement of a raw hairpiece and a plurality of manufacturing units provided in the present invention.
Figure 2:
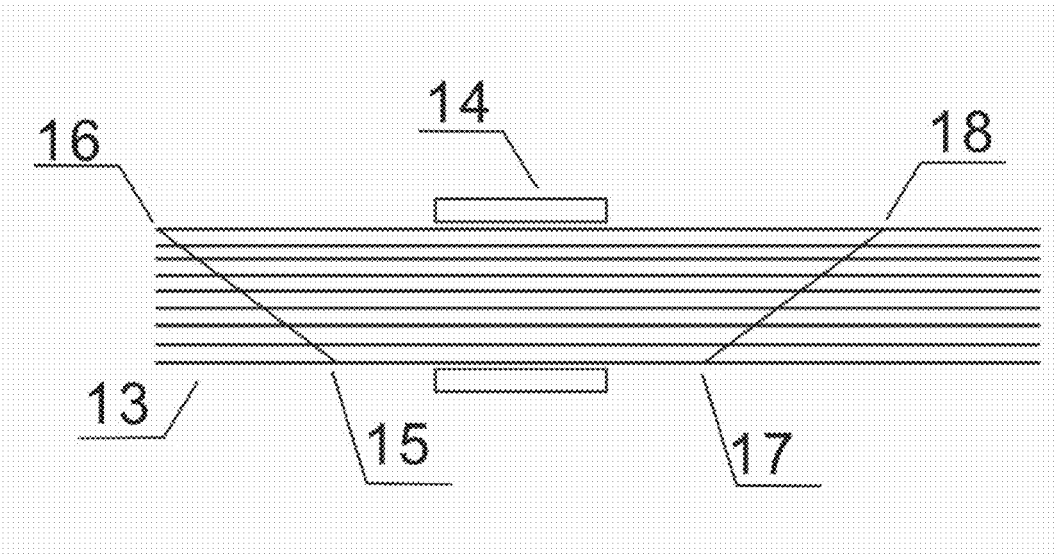
FIG. 2 is a schematic view for cutting a first manufacturing unit in the present invention.
Figure 3:
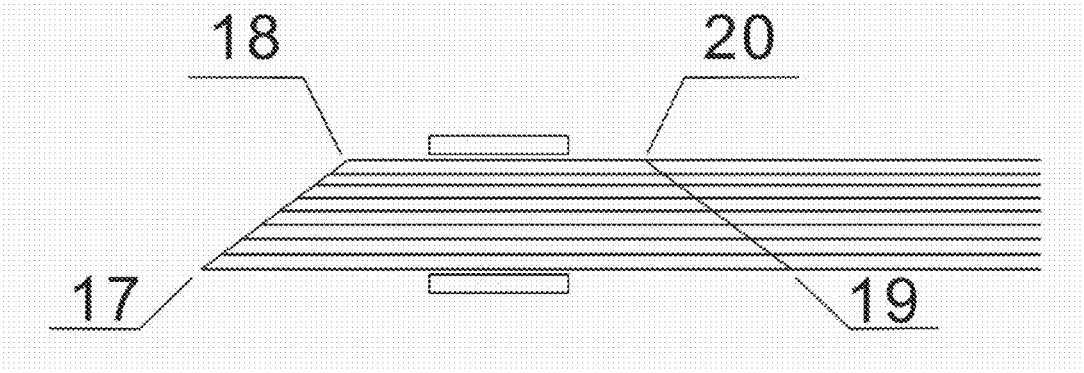
FIG. 3 is a schematic view for cutting a second manufacturing unit in the present invention.
Figure 4:
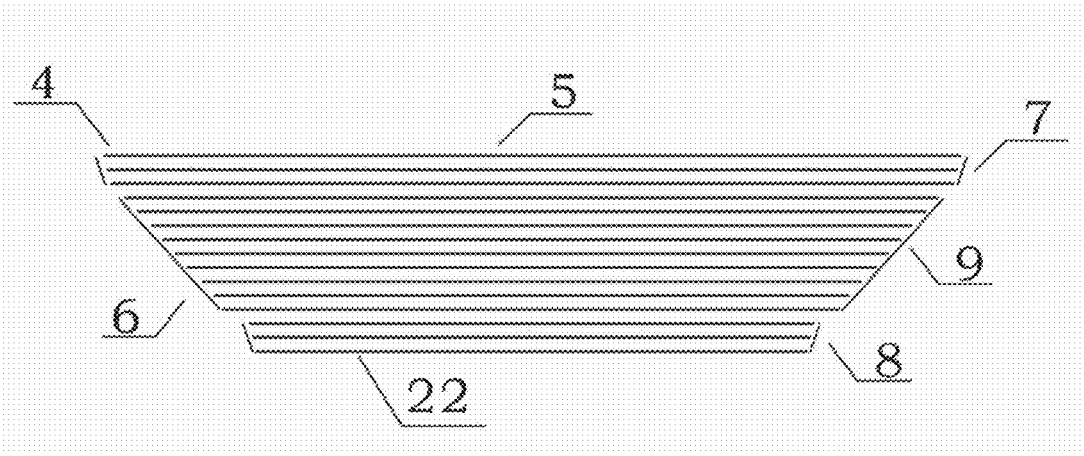
FIG. 4 is a schematic view of the trapezoidal shape of the manufacturing unit provided in the present invention.
Figure 5:
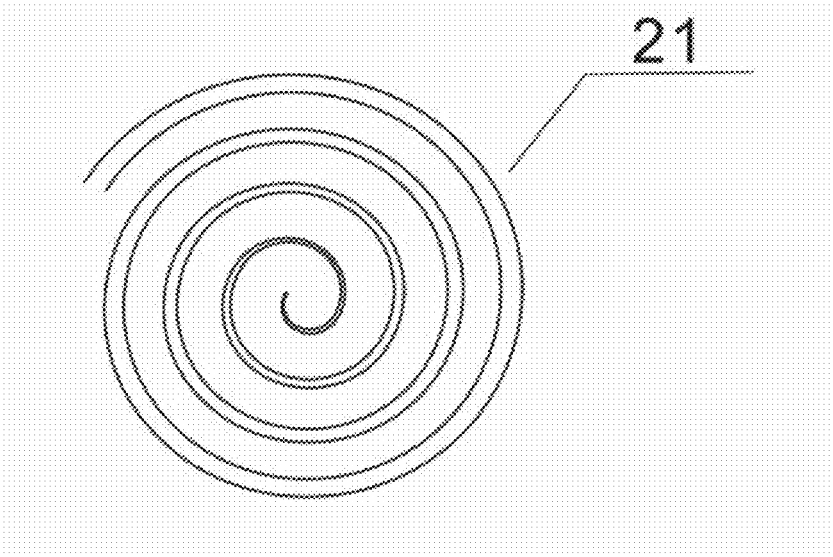
FIG. 5 is a schematic view for winding operation in the present invention.
Figure 6:
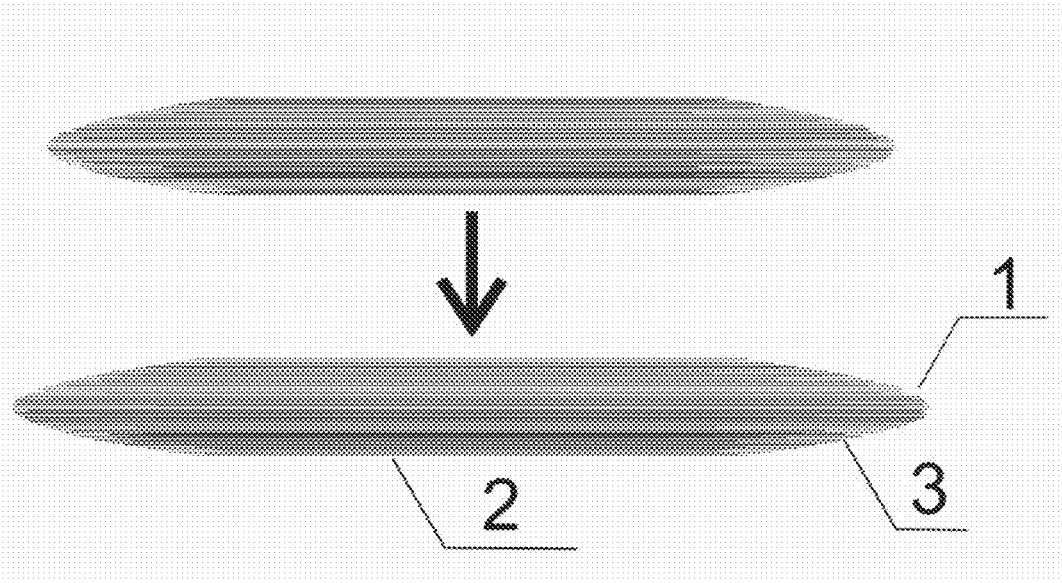
FIG. 6 is a schematic view for dragging operation in the present invention.

1. layered hairpiece product (referred to as hairpiece product for short); 2. main part of the hairpiece product;

3. layered part of the hairpiece product; 4. trapezoidal shape; 5. longer side of the trapezoidal shape; 6. lateral side of the trapezoidal shape; 7. start segment; 8. end segment; 9. middle segment; 10. raw hairpiece; 11. manufacturing unit; 12. start end of the raw hairpiece; 13. layered part corresponding to the lateral side of the trapezoidal shape; 14. processing plate; 15. first cutting point; 16. second cutting point; 17. third cutting point; 18. fourth cutting point; 19. fifth cutting point; 20. sixth cutting point; 21. circular hair bundle; 22. shorter side of the trapezoidal shape.

DETAILED DESCRIPTION OF EMBODIMENTS

The present invention is further described below in conjunction with the drawings and embodiments.

In the following part, the specific embodiments of the present invention will be described in detail. The preferable embodiments of the present invention are shown in the figures, which are used to graphically supplement the textual explanation in this description, so that each of the technical features and the overall technical solution of the present invention can be understood intuitively and pictorially. They should not be understood as limitation on the protective range of the present invention.

The technical solution used in the embodiment is as follows. A manufacturing method for preparing layered hairpiece product comprises the following steps:

step I. preparing a raw hairpiece 10;

step II. cutting a manufacturing unit: cutting one or more manufacturing units 11 having a trapezoidal shape 4 from the raw hairpiece 10; and step III. homogeneously mixing each manufacturing unit.

In the step II of cutting a manufacturing unit, the one or more manufacturing units 11 are cut from a start end 12 of the raw hairpiece successively.

The length of a longer side 5 of the trapezoidal shape of the manufacturing unit is smaller than the total length of the hairpiece product 1. The length of the layered part 13 corresponding to a lateral side of the trapezoidal shape is smaller than the length of the layered part 3 of the hairpiece product. The manufacturing method further comprises step IV of dragging the manufacturing unit: dragging the parts of the hair at two ends of the manufacturing unit 11 outwards to a certain length, until the length of the manufacturing unit reaches the total length of the hairpiece product.

The step IV of dragging the manufacturing unit is specifically carried out as follows: holding a middle part of the manufacturing unit by hand, and dragging the parts of the hair at two ends outwards to a certain length multiple times.

The step I of preparing a raw hairpiece is specifically carried out as follows: passing the start end 12 of the raw hairpiece between processing plates 14, with the raw hairpieces being arranged evenly between the processing plates 14 and the start end 12 of the raw hairpiece protruding from the processing plates 14 by a certain length.

The distance between two processing plates 14 is adjusted according to hair amount of the manufacturing unit.

The cutting of a first manufacturing unit in step II is specifically carried out as follows: beginning from the start end 12 of the raw hairpiece, on one side of the processing plates 14, cutting from a first cutting point 15 on one side of the raw hairpiece to a second cutting point 16 on the other side of the raw hairpiece in an inclined upward direction; then on the other side of the processing plates 14, cutting from a third cutting point 17 on one side of the raw hairpiece to a fourth cutting point 18 on the other side of the raw hairpiece in an inclined upward direction; and separating the first manufacturing unit having a trapezoidal shape formed by the first cutting point 15, the second cutting point 16, the third cutting point 17, and the fourth cutting point 18 from the remaining raw hairpiece at the lateral side formed by the third cutting point 17 and the fourth cutting point 18.

The cutting of a second manufacturing unit in step II is specifically carried out as follows: passing a start end of the remaining the raw hairpiece between the processing plates, with the remaining raw hairpieces being arranged evenly between the processing plates and the start end of the remaining raw hairpiece being the lateral side defined by the third cutting point and the fourth cutting point, then on the other side of the processing plates, cutting from a fifth cutting point 19 on one side of the raw hairpiece to a sixth cutting point 20 on the other side of the raw hairpiece in an inclined upward direction; separating the second manufacturing unit having a trapezoidal shape formed by the third cutting point 17, the fourth cutting point 18, the fifth cutting point 19, and the sixth cutting point 20 from the remaining raw hairpiece at the lateral side formed by the fifth cutting point 19 and the sixth cutting point 20; and repeating the cutting of the second manufacturing unit in the same way, in order to obtain a plurality of manufacturing units.

One or more of scissors, laser or forged blade is or are used as cutting tool, and the cutting is carried out manually or by machine.

The lateral side 6 of the trapezoidal shape is a segment or a plurality of segments of curve or straight line, the longer side 5 or the shorter side 22 of the trapezoidal shape is a start segment 7 or an end segment 8, and the middle part is a middle segment 9, the slopes and the hair amounts of the start segment 7, the end segment 8 and the middle segment 9 being determined according to the requirements of the layered part 3 of the hairpiece product.

The step III of homogeneously mixing each manufacturing unit is specifically carried out by manually mixing and combing, which are repeated multiple times.

The manual mixing can be carried out regularly or irregularly, and the combing is carried out by hand and comb.

The manual mixing is carried out through winding.

A first winding operation is specifically carried out as follows: winding the hair inwards to form a circular hair bundle 21, starting from the shorter side 22 or the longer side 5 of the trapezoidal shape. The combing is specifically carried out as follows: holding a middle part of the circular hair bundle after winding, teasing two ends of the hair by hand and comb, and putting down the circular hair bundle. A second winding operation is specifically carried out as follows: winding the hair inwards to form a circular hair bundle, starting from one side of the trapezoidal shape. The combing and the second winding operation are repeated successively multiple times.

The winding is carried out manually or by machine, and the combing is carried out manually or by machine.

The total number of winding operations is 2-8, and the total number of combing operations is 2-8. The length of the longer side 5, the length of the shorter side 22, and the length of the layered part 13 corresponding to the lateral side of the trapezoidal shape of the manufacturing unit are determined according to the requirements of the layered part 3 of the hairpiece product.

The embodiments of the present invention are described above in detail in conjunction with the drawings. However, the present invention should not be limited to the above embodiments, and various modifications are possible in the range of knowledge of an ordinary person skilled in the art, without departing from the essence of the present invention.

What is claimed is:

1. A manufacturing method for layered hairpiece product, wherein the method comprises the following steps:

step I: preparing a raw hairpiece;

step II: cutting a manufacturing unit: cutting one or more manufacturing units having a trapezoidal shape from the raw hairpiece;

step III: homogeneously mixing each manufacturing unit; and step IV: dragging the manufacturing unit: dragging parts of the hair at two ends of the manufacturing unit outwards to a certain length, until the length of the manufacturing unit reaches the total length of the hairpiece product;

wherein the length of a longer side of the trapezoidal shape of the manufacturing unit is less than the total length of the hairpiece product; the length of the layered part corresponding to a lateral side of the trapezoidal shape is less than the length of the layered part of the hairpiece product;

wherein the step IV of dragging the manufacturing unit is specifically carried out as follows:

holding a middle part of the manufacturing unit by hand, and dragging the parts of the hair at two ends outwards to a certain length multiple times.

2. The manufacturing method for layered hairpiece product according to claim 1, wherein in step II of cutting the manufacturing unit, the one or more manufacturing units are cut from a start end of the raw hairpiece successively.

3. The manufacturing method for layered hairpiece product according to claim 2, wherein the step I of preparing the raw hairpiece is specifically carried out as follows: passing the start end of the raw hairpiece between processing plates, with the raw hairpiece being arranged evenly between the processing plates and the start end of the raw hairpiece protruding from the processing plates by a certain length.

4. The manufacturing method for layered hairpiece product according to claim 3, wherein the distance between two processing plates is adjusted according to hair amount of the manufacturing unit.

5. The manufacturing method for layered hairpiece product according to claim 4, wherein the cutting of the first manufacturing unit in the step II is specifically carried out as follows: beginning from the start end of the raw hairpiece, on one side of the processing plates, cutting from a first cutting point on one side of the raw hairpiece to a second cutting point on the other side of the raw hairpiece in an inclined upward direction; then on the other side of the processing plates, cutting from a third cutting point on one side of the raw hairpiece to a fourth cutting point on the other side of the raw hairpiece in an inclined upward direction; and separating the first manufacturing unit having a trapezoidal shape formed by the first cutting point, the second cutting point, the third cutting point, and the fourth cutting point from the remaining raw hairpiece at the lateral side formed by the third cutting point and the fourth cutting point.

6. The manufacturing method for layered hairpiece product according to claim 5, wherein the cutting of a second manufacturing unit in step II is specifically carried out as follows: passing a start end of the remaining raw hairpiece between the processing plates, with the remaining raw hairpieces being arranged evenly between the processing plates and the start end of the remaining raw hairpiece being the lateral side defined by the third cutting point and the fourth cutting point, then on the other side of the processing plates, cutting from a fifth cutting point on one side of the raw hairpiece to a sixth cutting point on the other side of the raw hairpiece in an inclined upward direction; separating the second manufacturing unit having a trapezoidal shape formed by the third cutting point, the fourth cutting point, the fifth cutting point and the sixth cutting point from the remaining raw hairpiece at the lateral side formed by the fifth cutting point and the sixth cutting point, and repeating the cutting of the second manufacturing unit in the same way, in order to obtain a plurality of manufacturing units.

7. The manufacturing method for layered hairpiece product according to claim 6, wherein one or more of scissors, laser or forged blade is or are used as cutting tool, and the cutting is carried out manually or by machine.

8. The manufacturing method for layered hairpiece product according to claim 1, wherein the lateral side of the trapezoidal shape is a segment or a plurality of segments of curve or straight line, a part of the longer side or the shorter side of the trapezoidal shape is a start segment or an end segment, and the middle part is a middle segment, the slopes and the hair amounts of the start segment, the end segment and the middle segment being determined according to the requirements of the layered part of the hairpiece product.

9. The manufacturing method for layered hairpiece product according to claim 1, wherein the step III of homogeneously mixing each manufacturing unit is specifically carried out by manually mixing and combing, which are repeated multiple times.

10. The manufacturing method for layered hairpiece product according to claim 2, wherein the step III of homogeneously mixing each manufacturing unit is specifically carried out by manually mixing and combing, which are repeated multiple times.

11. A manufacturing method for layered hairpiece product, wherein the method comprises the following steps:

step I: preparing a raw hairpiece;

step II: cutting a manufacturing unit: cutting one or more manufacturing units having a trapezoidal shape from the raw hairpiece; and step III: homogeneously mixing each manufacturing unit;

wherein the step I of preparing the raw hairpiece is specifically carried out as follows: passing the start end of the raw hairpiece between processing plates, with the raw hairpiece being arranged evenly between the processing plates and the start end of the raw hairpiece protruding from the processing plates by a certain length;

wherein in step II of cutting the manufacturing unit, the one or more manufacturing units are cut from a start end of the raw hairpiece successively;

wherein the cutting of a first manufacturing unit in step II is specifically carried out as follows:

beginning from the start end of the raw hairpiece, on one side of the processing plates, cutting from a first cutting point on one side of the raw hairpiece to a second cutting point on the other side of the raw hairpiece in an inclined upward direction; then on the other side of the processing plates, cutting from a third cutting point on one side of the raw hairpiece to a fourth cutting point on the other side of the raw hairpiece in an inclined upward direction; and separating the first manufacturing unit having a trapezoidal shape formed by the first cutting point, the second cutting point, the third cutting point, and the fourth cutting point from the remaining raw hairpiece at the lateral side formed by the third cutting point and the fourth cutting point.

* * * * *